US007438246B2

(12) United States Patent
Saito

(10) Patent No.: US 7,438,246 B2
(45) Date of Patent: Oct. 21, 2008

(54) CASTING RUNNER CRUSHING DEVICE

(75) Inventor: Yoshitaka Saito, Kasuga (JP)

(73) Assignee: Hirado Kinzoku Kogyo Co., Ltd., Fukuoka (JP)

( * ) Notice: Subject to any disclaimer, the term of this patent is extended or adjusted under 35 U.S.C. 154(b) by 75 days.

(21) Appl. No.: 10/591,261

(22) PCT Filed: Mar. 1, 2005

(86) PCT No.: PCT/JP2005/003352

§ 371 (c)(1),
(2), (4) Date: Aug. 31, 2006

(87) PCT Pub. No.: WO2005/082537

PCT Pub. Date: Sep. 9, 2005

(65) Prior Publication Data

US 2007/0187535 A1 Aug. 16, 2007

(30) Foreign Application Priority Data

Mar. 2, 2004 (JP) ..... 2004-057617

(51) Int. Cl.
*B02C 1/10* (2006.01)

(52) U.S. Cl. ..... 241/264

(58) Field of Classification Search ..... 241/30, 241/264–268
See application file for complete search history.

(56) References Cited

FOREIGN PATENT DOCUMENTS

| | | |
|---|---|---|
| JP | 58-100950 | 7/1983 |
| JP | 5-19450 | 3/1993 |
| JP | 6-106083 | 4/1994 |
| JP | 3043636 | 9/1997 |
| JP | 2002-224580 | 8/2002 |

*Primary Examiner*—Mark Rosenbaum
(74) *Attorney, Agent, or Firm*—Jordan and Hamburg LLP

(57) ABSTRACT

The present invention provides a runner crushing device which is capable of breaking runners of complicated shape, with no broken runners sticking to its blades, and which has an advantageous effect that broken runners can be completely recovered. The device is constituted of a receiving blade and a hydraulically operated pushing blade. The receiving blade includes a plurality of plate-like longitudinal receiving blades having a predetermined height, and a plurality of transverse receiving blades each disposed between adjacent plate-like longitudinal receiving blades in a substantially orthogonal relationship thereto. The pushing blade includes cross-shaped pushing blade single bodies having a predetermined height juxtaposed in a plurality of rows, with each pushing blade single body being capable of entering a blade space defined between the longitudinal receiving blades and the transverse receiving blades in the receiving blade.

6 Claims, 4 Drawing Sheets

CASTING RUNNER CRUSHING DEVICE

TECHNICAL FIELD

The present invention relates to a crushing device capable of crushing a casting runner which is formed at the time of casting a cast product.

BACKGROUND OF THE INVENTION

Conventionally, in casting a cast product, molten steel is made to flow into a mold from a runner which is communicated with the mold and, after completion of casting, the runner is removed from the cast product and the separated runner is melted again by an electric furnace and is recycled.

However, the separated runners have a complicated branched shape and hence, when the runners are directly cast into the electric furnace with profiles thereof maintained as it is, the complicated shapes are overlapped or are entangled thus increasing a total capacity of the runners. Accordingly, it is not possible to cast an amount of runners which can sufficiently fill or fully occupy a capacity of the inside of the electric furnace and hence, a so-called yielding rate is lowered thus deteriorating a melting recovery efficiency of the runners.

Accordingly, it is necessary to preliminarily crush the casting runner before charging the casting runner into the electric furnace. A hydraulic crusher has been used for this end.

The crusher is constituted of a receiving blade, a pushing blade and a hydraulic device which drives the pushing blade. By introducing a broken runner having a complicated shape between both blades, the runner is crushed due to a clamping force generated by both blades (see patent document 1).

Patent document 1: Japanese Laid-open Patent Hei6(1994)-106083.

Here, it is often the case with such a crusher that the runner which is crushed due to clamping by the receiving blade and the pushing blade sticks to a blade base body. Accordingly, even when the receiving blade and the pushing blade are separated from each other after crushing the runner, it is difficult to recover runner pieces which are finely crushed. Further, an engaging shape of the receiving blade and the pushing blade adopts a simple cutting scissors-like shape and hence, it is not always possible to form the crushed runner pieces into a finely-crushed shape whereby there has been a drawback that desired finely-crushed runners suitable for melting in the electric furnace cannot be obtained.

DISCLOSURE OF THE INVENTION

Accordingly, the present invention provides a casting runner crushing device which includes a receiving blade and a hydraulically-operated pushing blade, wherein the receiving blade comprises a plurality of plate-like longitudinal receiving blades having a predetermined height, and a plurality of plate-like transverse receiving blades each disposed between adjacent plate-like longitudinal receiving blades in a substantially orthogonal relationship thereto, and the pushing blade includes cross-shaped pushing blade single bodies of a predetermined height juxtaposed in a plurality of rows, with each pushing blade single body being capable of entering a blade space defined between longitudinal receiving blades and transverse receiving blades in the receiving blade.

The runner crushing device is also characterized in that a step in height is formed between an upper-end brim of the longitudinal receiving blades and an upper-end brim of the transverse receiving blades in the receiving blades.

The runner crushing device is also characterized in that a bottom plate is mounted on middle portions of the plurality of transverse receiving blades in the receiving blades, and the transverse receiving blades and the bottom plate are configured to be inverted in the vertical direction.

Further, the pushing blade is configured to be rotatable in the receiving blade direction about a proximal end portion thereof.

BEST MODE FOR CARRYING OUT THE INVENTION

In the present invention, a runner crushing device includes pushing blades which are hydraulically rotatable about proximal end portions thereof and receiving blades which receive the pushing blades, wherein plate-like longitudinal receiving blades and plate-like transverse receiving blades are arranged orthogonally to each other thus forming rectangular blade space portions in the receiving blade, and an approximately cross-shaped pushing-blade single body of the pushing blade is inserted into the blade space portion, and a step is formed between a height of the longitudinal receiving blade and a height of the transverse receiving blade in the receiving blade. Accordingly, when a large number of runners having a complicated shape are charged onto the receiving blades, the runners are placed astride between the longitudinal receiving blades and the transverse receiving blades in a complicated manner.

Next, by hydraulically rotating the pushing blade about a proximal end portion thereof thus inserting the approximately cross-shaped pushing-blade single body into the blade space portion defined by the longitudinal receiving blades and the transverse receiving blades, the runners are finely cut or sheared and are crushed into fine pieces due to a shearing action generated by the plate-like longitudinal receiving blades and transverse receiving blades of the receiving blades and the pushing blades and the and, at the same time, due to the provision of the plate-like receiving blades and the approximately cross-shaped pushing blades, there is no possibility that the crushed runners stick to the blades.

By turning over the transverse receiving blade of the receiving blades in the vertical direction after crushing the runners, the crushed runners which are stored on inner bottom surfaces of the receiving blades are discharged downwardly and are recovered by a predetermined means such as a belt conveyor, a recovering box or the like.

Embodiment

Hereinafter, an embodiment of a casting runner crushing device A according to the present invention is specifically explained in conjunction with drawings.

Figure 1:
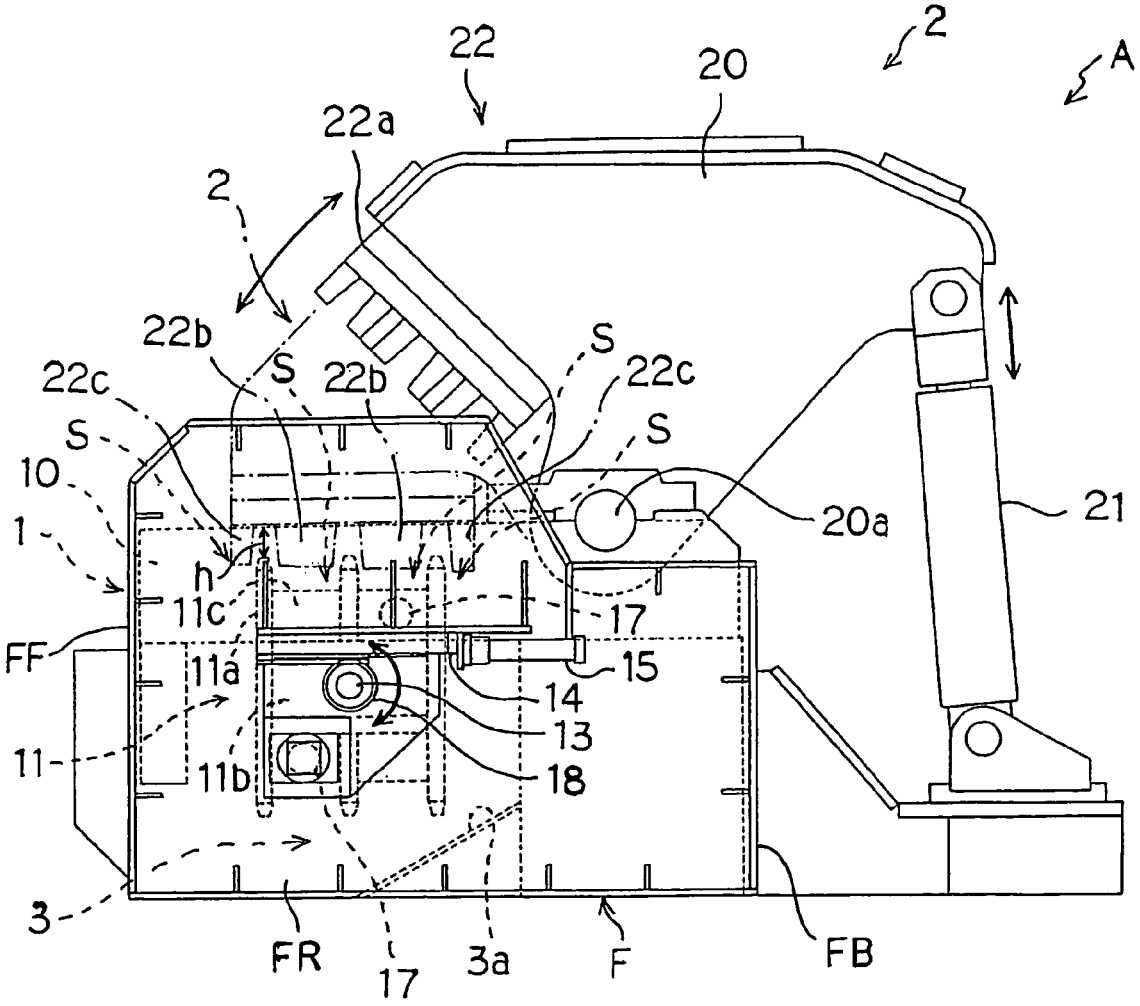
FIG. 1 is a right side view of a whole casting runner crushing device according to the present invention.
Figure 2:
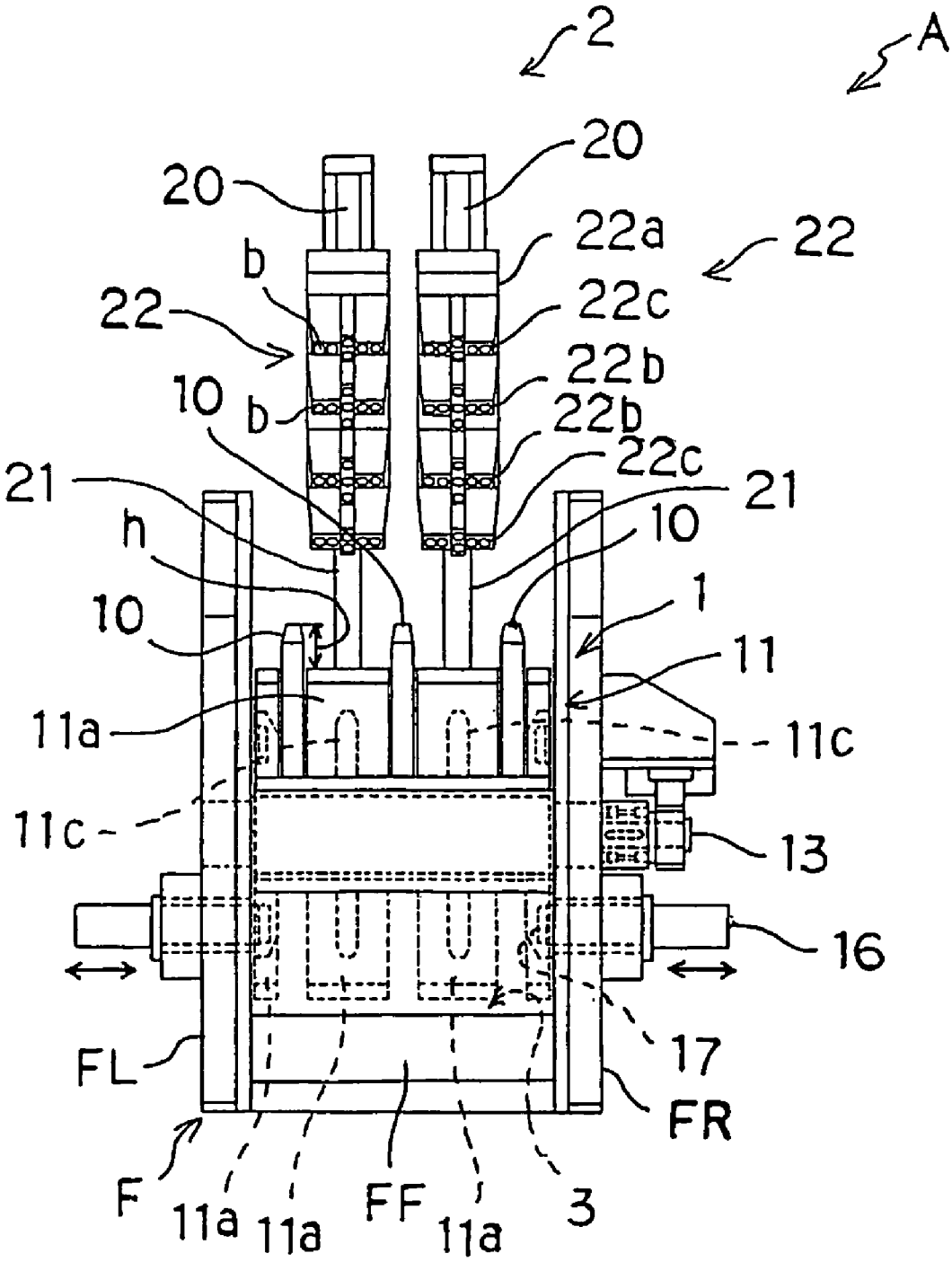
FIG. 2 is a front view of the whole casting runner crushing device according to the present invention.
Figure 3:
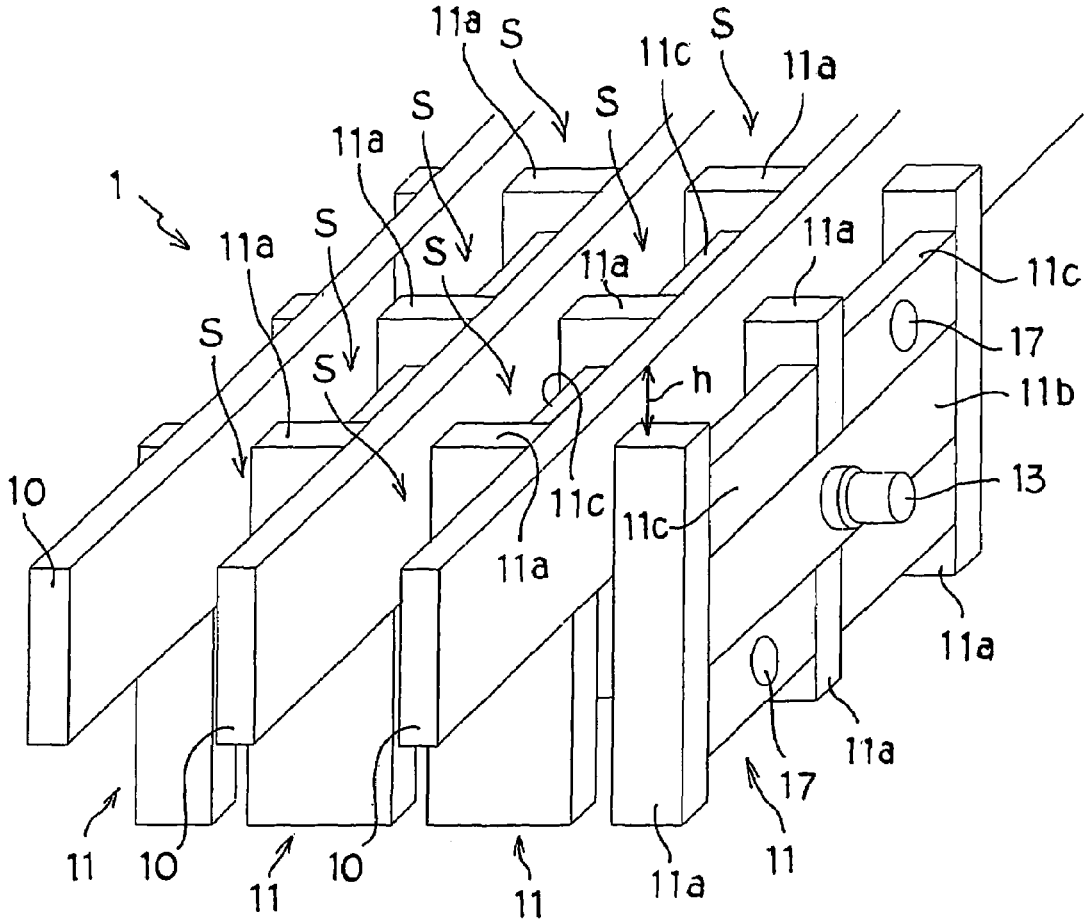
FIG. 3 is a perspective explanatory view showing receiving blades.
Figure 4:
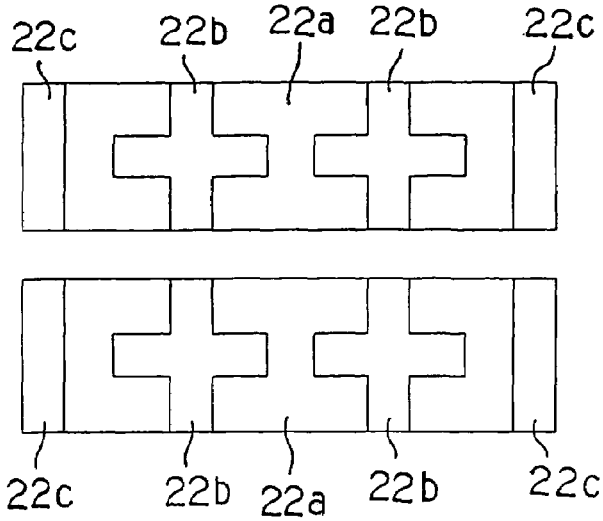
FIG. 4 is an explanatory view of a front end of a pushing-blade single body.
Figure 5:
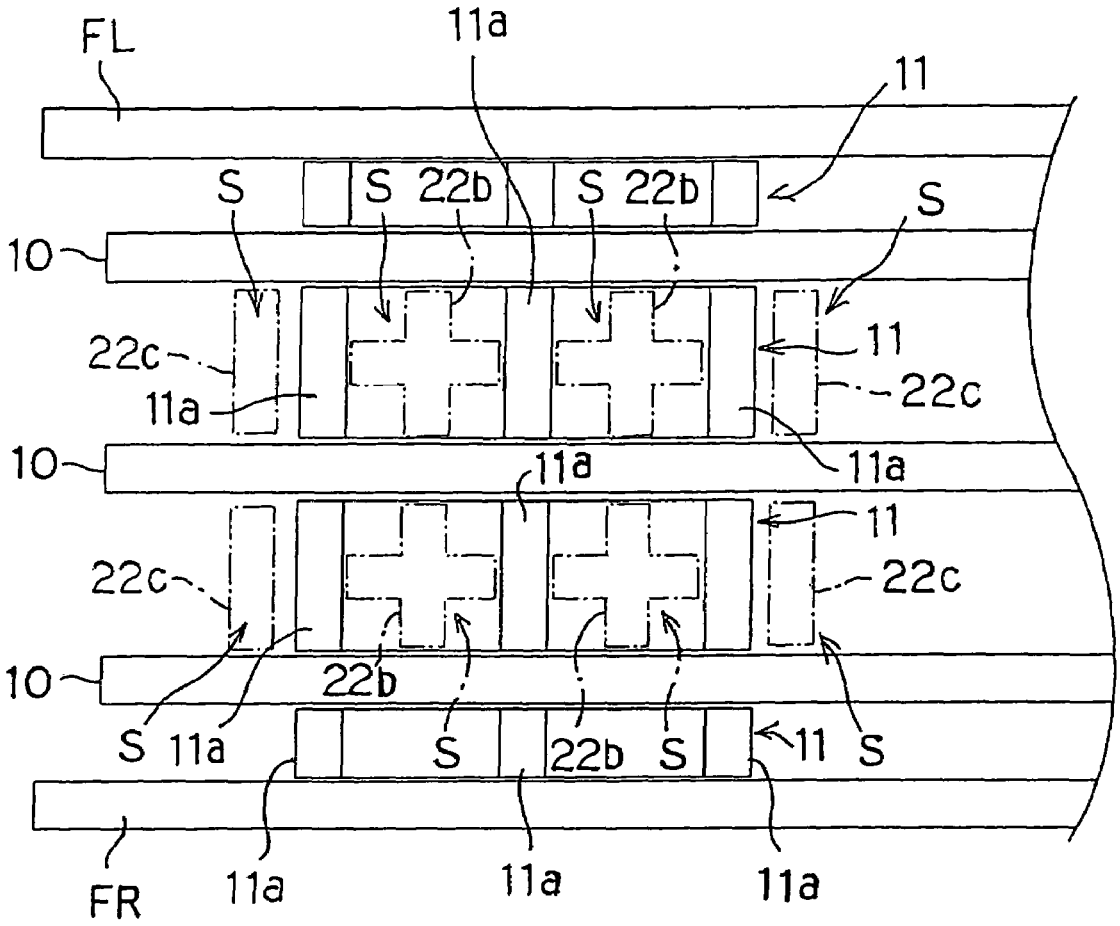
FIG. 5 is an explanatory view showing a state that the pushing blades are inserted into the receiving blades.

FIG. 1 is a right side view of a whole runner crushing device A according to the present invention, FIG. 2 is a front view of the whole runner crushing device A according to the present invention, FIG. 3 is a perspective explanatory view showing receiving blades, FIG. 4 is an explanatory view of a front end of a pushing-blade single body, and FIG. 5 is an explanatory view showing a state that the pushing blades are inserted into the receiving blades. Here, in FIG. 3 to FIG. 5, bolts for mounting distal ends of pushing blades and receiving blades are omitted.

The casting runner crushing device A according to the present invention is, as shown in FIG. 1 and FIG. 2, constituted of a crushing casing F, a receiving blade 1 which is arranged in the inside of the crushing casing F and a pushing blade 2 which is pivotally supported above the receiving blade 1 in a state that the receiving blade 1 can be opened and closed.

In such a casting runner crushing device A, runners (hereinafter simply referred to as runners) are placed on the receiving blade 1 which are constituted of longitudinal receiving blades 10 and the transverse receiving blades 11, and the runners are pushed and crushed by the pushing blade 2.

The crushing casing F is, as shown in FIG. 1 and FIG. 2, formed in a box shape having upper and lower ends thereof opened and is constituted of left and right side walls FL,FR and front and rear walls FF, FB.

Between the left and right side walls FL,FR, as shown in FIG. 2 and FIG. 5, one or a plurality of (three in this embodiment) longitudinal receiving blades 10,10,10 which form intermediate side walls are arranged.

Further, the transverse receiving blades 11 are, as shown in FIG. 3, constituted by arranging a plurality of transverse receiving blade single bodies 11*a*,11*a*,11*a*, . . . which are formed of a longitudinally elongated plate between the respective longitudinal receiving blades 10,10,10 approximately orthogonally at a fixed interval.

Further, the respective transverse receiving blade single bodies 11*a*, 11*a*, 11*a*, . . . are mounted upright on a horizontal bottom plate 11*b* which extends in the fore-and-aft direction while maintaining a fixed interval. Accordingly, the transverse receiving blade single bodies 11*a*, 11*a*, 11*a*, . . . and the bottom plate 11*b* are configured to form the integral constitution and to move separately from the longitudinal receiving blades 10 as a separate body.

In this manner, in the inside of the crushing casing F, approximately rectangular blade space portions S which are surrounded by the respective transverse receiving blade single bodies 11*a*,11*a*,11*a*, . . . and the above-mentioned longitudinal receiving blades 10,10,10 are formed. In the inside of the blade space portions S, pushing blade single bodies 22*b*, 22*c* of a pushing blade 2 which are described later are fitted or inserted at the time of performing the crushing operation.

Further, between upper end brim portions of the respective transverse receiving blade single bodies 11*a*, 11*a*, 11*a*, . . . and upper end brim portions of the above-mentioned longitudinal receiving blades 10, as shown in FIG. 1 to FIG. 3, a step (a step in height) "h" which makes the former higher than the latter is formed.

Due to such constitution, it is possible to place runners having a complicate shape in a state that the runners stride over the respective upper end brim portions of the respective transverse receiving blade single bodies 11*a*, 11*a*, 11*a*, . . . and the longitudinal receiving blades 10, 10, 10 in a complicated manner. Accordingly, in crushing the runners by pushing using the pushing blade 2, it is possible to more easily break the runners by bending thus enhancing a crushing effect.

Further, these longitudinal receiving blades 10 and the respective transverse receiving blade single bodies 11*a*, 11*a*, 11*a*, . . . are formed in a plate shape and have respective upper brims thereof sharpened to prevent the sticking of the runners to upper end surfaces of the longitudinal receiving blades 10 and the respective transverse receiving blade single bodies 11*a* after crushing as much as possible.

A support shaft 13 penetrates the bottom plate 11*b* which is contiguously formed on lower end portions of the transverse receiving blade single bodies 11*a* at an approximately fore-and-aft center position of the bottom plate 11*b*. Both ends of the support shaft 13 penetrate the left and right side walls FL,FR of the crushing casing F and are rotatably and pivotally supported between the left and right side walls FL,FR.

Accordingly, the transverse receiving blades 11 are configured to be vertically turned over by 180 degrees about the support shaft 13 together with the bottom plate 11*b*.

On the other hand, as shown in FIG. 1, outside the crushing casing F, a rack 14 is connected to a hydraulic cylinder 15, and the rack 14 is meshed with a pinion gear 18 which is mounted on a shaft end of the support shaft 13, and the support shaft 13 is rotated by the actuation of the hydraulic cylinder 15.

In this manner, by arranging the longitudinal receiving blades 10 and the transverse receiving blades 11 in an intersecting manner, by constituting both receiving blades 10, 11 as separately movable parts, and by vertically turning over the transverse receiving blades 11, it is possible to make the crushed runners which fall on the bottom plate 11*b* fall downwardly in the crushing casing F to enable the recovery of the crushed runners while preventing the sticking of the crushed runner to the end brims of both blades 10, 11.

Further, as shown in FIG. 1 to FIG. 3, between the respective transverse receiving blade single bodies 11*a*, 11*a*, 11*a*, . . . in the fore-and-aft direction and above the bottom plate 11*b*, ribs 11*c* which are formed of a rectangular plate are provided.

A front end and a rear end of the rib 11*c* are respectively brought into contact with the respective transverse receiving blade single bodies 11*a*,11*a* thus reinforcing the respective transverse receiving blade single bodies 11*a*,11*a*.

Due to such a constitution, a pushing force and a tensile force which are applied to the respective transverse receiving blade single bodies 11*a*, 11*a*, 11*a*, . . . during the crushing operation are made uniform.

Further, in the ribs 11*c* which are formed on the transverse receiving blades 11, 11 arranged on the left and right side walls FL, FR out of the above-mentioned transverse receiving blades 11,11,11,11, stopper insertion holes 17 are formed at predetermined positions and the rotation of the transverse receiving blades 11 can be prevented by inserting transverse receiving blades fixing stoppers 16 in the stopper insertion holes 17.

The transverse receiving blades fixing stoppers 16 are respectively arranged outside the left side wall FL and the right side wall FR and at positions corresponding to the above-mentioned stopper insertion holes 17, and are configured slidable toward the inside of the crushing casing F. In this manner, the transverse receiving blades fixing stoppers 16 can be detachably inserted into the stopper insertion holes 17.

Accordingly, by inserting the transverse receiving blades fixing stoppers 16 into the stopper insertion holes 17, it is possible to prevent the rotation of the transverse receiving blades 11 thus preventing the erroneous rotation of the transverse receiving blades 11 at the time of crushing the runners which are placed on the receiving blades 1 by the pushing blades 2.

On the other hand, as shown in FIG. 2, the pushing blade 2 which is lowered into the inside of the casing F from above the crushing casing F by rotation is constituted of a plurality of (two in this embodiment) pushing blade single bodies 22,22 which are juxtaposed in the lateral direction so as to face the receiving blade 1.

The pushing blade single body 22 is, as shown in FIG. 1, configured such that a pushing blade rotary support portion 20 is formed in an approximately inverse-triangular shape in a side view, a rotary shaft 20*a* which extends an axis thereof in the lateral direction is extended between rear upper portions of the longitudinal receiving blades 10,10,10, and a inverse-triangular lower-end peak portion of the pushing blade rotary support portion 20 is pivotally supported on the rotary shaft 20*a* whereby the pushing blade single body 22 is rotatable into the inside of the crushing casing F from above the crushing casing F about the rotary shaft 20*a*.

On a front end surface of the rotary support portion 20, as shown in FIG. 1, FIG. 2 and FIG. 4, a rectangular blade base body 22*a* is mounted. Pushing blade single body elements 22*c*,22*c* having an approximately one-line-plate-like shape which extend in the lateral direction are formed on both end brims on an upper surface of the blade base body 22*a* in a projecting manner and, at the same time, pushing blade single body elements 22*b*,22*b* having an approximately cross-plate-like shape which cross in the fore-and-aft direction and left-and-right direction are formed upright on an approximately center portion on the upper surface of the blade base body 22*a*.

In this manner, with the provision of the pushing blade single body elements 22*b*,22*b*,22*c*,22*c* on the pushing blade single body 22, at the time of performing the crushing operation of the runners, it is possible to surely shear and crush even the runners having a complicated shape by respectively applying complicated pushing and crushing stresses from multiple directions.

On the other hand, rear-end peak portions of a plurality of pushing blade rotary support portions 20, 20 are contiguously connected to a plurality of hydraulic cylinders 21, 21 for rotating the pushing blades which are arranged behind the crushing casing F.

Accordingly, by lifting the rear ends of the pushing blade rotary support portions 20,20 with the use of the plurality of hydraulic cylinders 21 using the rotary shaft 20*a* as a fulcrum, there arises a principle of leverage which uses the lifting point as a point of force and the pushing blade single body elements 22*b*,22*b*,22*c*,22*c* which are formed on end surfaces of the plurality of pushing blade rotary support portions 20,20 as a point of action and hence, an effective pushing force is generated whereby the runner crushing operation can be performed effectively with a small load.

Further, a plurality of pushing blade single bodies 22 which are constituted of the plurality of pushing blade rotary support portions 20, the blade base bodies 22*a*, the pushing blade single body members 22*b*, 22*b*, 22*c*, 22*c* are arranged laterally in plural numbers to work separately and the hydraulic cylinders 21, 21 are contiguously connected to the plurality of pushing blade single bodies 22 and hence, by providing a time lag to the operations of the left and right hydraulic cylinders 21, 21, a fixed operation time lag is generated between separate works of the plurality of pushing blade single bodies 22 whereby the plurality of pushing blade single bodies 22 apply the time-lag operations to the receiving blades 1 so as to impart a complicated pushing force to the runners thus generating the complicated crushing of the runners.

Further, the respective pushing blade single body members 22*b*, 22*b*, 22*c*, 22*c* are, as indicated by chained lines in FIG. 1 and FIG. 5, configured to be positioned where the respective pushing blade single body members 22*b*, 22*b*, 22*c*, 22*c* are inserted into the blade space portions S of the receiving blade 1 when the pushing blade 2 is rotated and lowered toward the receiving blade 1. That is, the crushing of runners is not performed in a state that the respective pushing blade single body members 22*b*, 22*b*, 22*c*, 22*c*, the longitudinal receiving blade 10 and the transverse receiving blades 11 sandwich the runners but is performed in a state that the respective pushing blade single body members 22*b*, 22*b*, 22*c*, 22*c* are pushed into the blade space portions S thus providing the crushing structure which prevents the crushed runners from sticking to the longitudinal receiving blade 10, the transverse receiving blade single bodies 11*a* and the pushing blade single body members 22*b*, 22*c*.

By constituting the receiving blade 1 and the pushing blade 2 in this manner, at the time of performing the runner crushing operation, it is possible to prevent the crushed runners from sticking to the longitudinal receiving blades 10, the transverse receiving blade single bodies 11*a* and the pushing blade single body members 22*b*, 22*c* of the pushing blade 2 and, at the same time, the runners crushing effect can be enhanced.

Here, in this embodiment, the plurality of left and right pushing blade single bodies 22, 22 are configured to work separately due to the respective hydraulic cylinders 21, 21. However, by integrally connecting the respective pushing blade single bodies 22, 22 using a connecting jig (not shown in the drawing), the respective pushing blade single bodies 22, 22 may be configured to be integrally rotated. In this case, the hydraulic cylinders may be formed into a single body.

Further, sharpened portions formed on respective distal ends of the above-mentioned longitudinal receiving blades 10, the transverse receiving blade single bodies 11*a* and the pushing blade single body members 22*b*, 22*c* are formed separately from bodies such that the sharpened portions are detachable from the bodies.

Accordingly, when the sharpened portions formed on the respective distal end of the above-mentioned longitudinal receiving blades 10, the transverse receiving blade single bodies 11*a* and the pushing blade single body members 22*b*, 22*c* are broken during the crushing operation or are deteriorated along with a lapse of time, the distal-end sharpened portions of the longitudinal receiving blades 10, the transverse receiving blade single bodies 11*a* and the pushing blade single body members 22*b*, 22*c* can be removed from the bodies to be exchanged with new blade bodies.

Here, in FIG. 2, symbol b indicates bolts for detachably mounting the distal-end sharpened portions of the above-mentioned longitudinal receiving blades 10, transverse receiving blade single bodies 11*a* and pushing blade single body members 22*b*, 22*c* on the bodies.

Below the transverse receiving blades 11, as shown in FIG. 1 and FIG. 2, a crushed runner recovery portion 3 which recovers the discharged crushed runners is provided.

The crushed runner recovery portion 3 is, as shown in FIG. 1, formed below the transverse receiving blades 11 which are vertically turned over about the support shaft 13, wherein a bottom surface 3*a* of the crushed runner recovery portion 3 is inclined toward a front side of the crushing casing F with a downward gradient such that the crushed runners which fall on the bottom plate 11*b* of the turned-over transverse receiving blades 11 are collected to a front side of the crushed runner recovery portion 3.

In this manner, by collecting the crushed runners to the front side of the crushed runner recovery portion 3, it is possible to effectively and collectively recover the crushed runners.

Here, it may be possible to further enhance the recovery efficiency of the crushed runners by providing a recovery means such as a belt conveyor or a recovery box to the crushed runner recovery portion 3.

The casting runner crushing device A of this embodiment is constituted as described above. Hereinafter, the explanation is made with respect to a crushing step in which the runners are crushed using the above-mentioned casting runner crushing device A.

(1) The pushing blade 2 is rotated upwardly to bring the receiving blade 1 into an open state and, at the same time, the transverse receiving blades fixing stoppers 16 are inserted into the stopper insertion holes 17 so as to fix the transverse receiving blades 11.

(2) A large number of runners are charged onto the receiving blade 1.

Here, the step (the step in height) "h" is formed between the heights of the upper end brims of the longitudinal receiving blades 10, 10, 10 and the respective transverse receiving blade single bodies 11*a*, 11*a*, 11*a* . . . which constitute the receiving blade 1 and hence, the runners are placed astride between the upper end brims of the longitudinal receiving blades 10, 10, 10 and the respective transverse receiving blade single bodies 11*a*, 11*a*, 11*a* . . . in an inclined state, in a horizontal state or the like at random.

(3) By operating the respective hydraulic cylinders 21, 21 in an extending manner with a time lag, the respective pushing blade rotary support portions 20, 20 which include the pushing blade single body members 22*b*, 22*b*, 22*c*, 22*c* are rotated about the rotary shaft 20*a* with a fixed time lag thus lowering the respective pushing blade rotary support portions 20, 20 in the direction of the receiving blades 1 with the time lag respectively whereby the approximately cross-shaped and the approximately one-straight-line-shaped pushing blade single body members 22*b*, 22*b*, 22*c*, 22*c* are inserted into the inside of the blade space portions S. Accordingly, the runners which are astride between the longitudinal receiving blades 10, 10, 10 and the respective transverse receiving blade single bodies 11*a*, 11*a*, 11*a*, . . . receive complicated pushing and crushing stresses from many directions by the approximately cross-shaped and the approximately one-straight-line-shaped pushing blade single body members 22*b*, 22*c* and hence, the runners are finely broken and crushed into pieces.

Further, since the longitudinal receiving blades 10, 10, 10 and transverse receiving blade single bodies 11*a*, 11*a*, 11*a*, . . . are formed in a plate shape, the finely broken runners hardly stick to the longitudinal receiving blades 10, 10, 10 and transverse receiving blade single bodies 11*a*, 11*a*, 11*a*, . . . . Further, the pushing blade 2 allows only the pushing blade single body members 22*b*, 22*b*, 22*c*, 22*c* to be inserted into the blade space portions S of the receiving blade 1 and hence, there is also no possibility that the finely broken runners stick to the distal end surfaces of the pushing blade single body members 22*b*, 22*b*, 22*c*, 22*c*.

Further, the pushing blade 2 is rotated about the rotary shaft 20*a* by making use of the principle of leverage and hence, it is possible to generate the pushing force effectively whereby the crushing operation can be effectively performed with a small load.

Here, a plurality of pushing blade single bodies 22 which are constituted of the plurality of pushing blade rotary support portions 20, the blade base bodies 22*a*, the pushing blade single body members 22*b*, 22*b*, 22*c*, 22*c* are arranged laterally in plural numbers to work separately and the hydraulic cylinders 21, 21 are contiguously connected to the plurality of pushing blade single bodies 22. Accordingly, by providing a time lag to the operations of the left and right hydraulic cylinders, with respect to the runners which are astride over the lateral blade space portions S, S in an inclined state out of the runners which are placed between upper end brims of the longitudinal receiving blades 10, 10, 10 and the respective transverse receiving blade single bodies 11*a*, 11*a*, 11*a*, . . . , either one of respective pushing blade single body members 22*b*, 22*c* out of the respective pushing blade single body members 22*b*, 22*c* of the respective pushing blade rotary support portions 20, 20 which are lowered by rotation firstly coming into contact with the above-mentioned inclined runners and hence, the inclined runners assume a state in which the runners are pushed and fixed by the pushing blade single body members 22*b*, 22*c*.

The runners in such a fixed state can be sheared and broken with a further effective pushing force due to the operation of the respective pushing blade single body members 22*b*, 22*c* on a side which are not brought into contact with the runners with the fixed time lag.

In this manner, before inserting the respective pushing blade single body members 22*b*, 22*c* into the blade space portions S, the runners which are placed astride over the lateral blade space portions S, S in an inclined state are preliminarily roughly sheared and broken by making use of the fixed operational time lag and hence, it is possible to smoothly perform the crushing operation at the time of inserting the respective pushing blade single body members 22*b*, 22*c* into the blade space portions S, S thereafter whereby it is possible to obtain an advantageous effect that the narrow runners can be also surely crushed into fine pieces.

(4) By removing the above-mentioned transverse receiving blade fixing stoppers 16 and, at the same time, by vertically turning over the transverse receiving blades 11, the crushed runners which fall on the bottom plates 11*b* of the transverse receiving blades 11 fall into and are recovered by the crushed runner recovery portion 3.

In this manner, the crushing device of this embodiment can crush the runners into fine pieces and, at the same time, can completely recover the crushed runners.

INDUSTRIAL APPLICABILITY

According to the present invention, the casting runner crushing device includes the receiving blade and the hydraulically-operated pushing blade, wherein the receiving blade comprises a plurality of plate-like longitudinal receiving blades having a predetermined height, and a plurality of plate-like transverse receiving blades each disposed between adjacent plate-like longitudinal receiving blades in a substantially orthogonal relationship thereto, and the pushing blade includes cross-shaped pushing blade single bodies of a predetermined height juxtaposed in a plurality of rows, with each pushing blade single body being capable of entering the blade space portion defined between the longitudinal receiving blade and the transverse receiving blade in the receiving blade. Accordingly, even the runners having the complicated shape can be finely crushed with the cross-shaped pushing blade single bodies and, at the same time, the longitudinal receiving blades and the transverse receiving blades are formed in a plate shape and hence, the runners which are finely crushed do not stick to the receiving blades. Further, the pushing blades also allow only the cross-shaped pushing blade single bodies to be inserted into the blade space portions of the receiving blades and hence, the finely crushed runners also do not stick to the pushing blades thus giving rise to the advantageous effect that the crushed runners can be completely recovered.

According to the present invention, a step is formed between an upper-end brim of the longitudinal receiving blades and an upper-end brim of the transverse receiving blades in the receiving blades and hence, the runners having a complicated shape are held by the step in a striding manner by the pushing blades whereby the runners can be more easily bent and broken thus enhancing the crushing effect.

According to the present invention, a bottom plate is mounted on middle portions of the plurality of transverse receiving blades in the receiving blades, and the transverse receiving blades and the bottom plate are configured to be turned over in the vertical direction. Accordingly, the crushed runners which are stored on an inner bottom portion of the transverse receiving blades can be discharged downwardly by turning down the transverse receiving blade thus enhancing the crushed runner recovery.

According to the present invention, the pushing blade is configured to be rotatable in the receiving blade direction about a proximal end portion thereof and hence, it is possible to effectively generate the pushing force by making use of a principle of leverage due to the hydraulic pressure whereby the crushing operation can be effectively performed with the small load.

The invention claimed is:

1. A casting runner crushing device comprising a receiving blade; and a hydraulically-operated pushing blade, wherein the receiving blade is comprised of a plurality of plate-like longitudinal receiving blades having a predetermined height, a plurality of transverse receiving blades each disposed between adjacent plate-like longitudinal receiving blades in a substantially orthogonal relationship thereto, and the longitudinal receiving blades and transverse receiving blades in the receiving blade being spaced to form a plurality of approximately rectangular blade space portions there between, and the pushing blade is comprised of cross-shaped pushing blade single bodies of a predetermined height juxtaposed in a plurality of rows, with each pushing blade single body being capable of entering the blade space portion defined between longitudinal receiving blades and transverse receiving blades in the receiving blade.

2. A casting runner crushing device according to claim 1, wherein a step in height is formed between an upper-end brim of the longitudinal receiving blades and an upper-end brim of the transverse receiving blades in the receiving blades.

3. A casting runner crushing device according to claim 2, wherein a bottom plate is mounted on middle portions of the plurality of transverse receiving blades in the receiving blades, and the transverse receiving blades and the bottom plate are configured to be inverted in the vertical direction.

4. A casting runner crushing device according to any one of claims 1 to 3, wherein the pushing blade is configured to be rotatable in the receiving blade direction about a proximal end portion thereof.

5. A casting runner crushing device comprising a receiving blade and a hydraulically-operated pushing blade, wherein the receiving blade includes a plurality of plate-like longitudinal receiving blades having a predetermined height, and a plurality of transverse receiving blades each disposed between adjacent plate-like longitudinal receiving blades in a substantially orthogonal relationship thereto, and the pushing blade includes cross-shaped pushing blade single bodies of a predetermined height juxtaposed in a plurality of rows, with each pushing blade single body being capable of entering a blade space portion defined between the longitudinal receiving blades and the transverse receiving blades in the receiving blade, and wherein a bottom plate is mounted on middle portions of the plurality of transverse receiving blades in the receiving blades, and the transverse receiving blades and the bottom plate are configured to be inverted in the vertical direction.

6. A casting runner crushing device comprising a receiving blade and a hydraulically-operated pushing blade, wherein the receiving blade includes a plurality of plate-like longitudinal receiving blades having a predetermined height, and a plurality of transverse receiving blades each disposed between adjacent plate-like longitudinal receiving blades in a substantially orthogonal relationship thereto, and the pushing blade includes cross-shaped pushing blade single bodies of a predetermined height juxtaposed in a plurality of rows, with each pushing blade single body being capable of entering a blade space portion defined between the longitudinal receiving blades and the transverse receiving blades in the receiving blade, and wherein a bottom plate is mounted on middle portions of the plurality of transverse receiving blades in the receiving blades, and the transverse receiving blades and the bottom plate are configured to be inverted in the vertical direction, and the pushing blade is configured to be rotatable in the receiving blade direction about a proximal end portion thereof.

* * * * *